US006527404B2

(12) United States Patent
Wang

(10) Patent No.: US 6,527,404 B2
(45) Date of Patent: Mar. 4, 2003

(54) RATCHET WRENCH AND LIGHTING CIRCUIT ARRANGEMENT

(76) Inventor: Lai-Fu Wang, No. 425, Hsihu Rd., Tali City, Taichung County (TW)

( * ) Notice: Subject to any disclaimer, the term of this patent is extended or adjusted under 35 U.S.C. 154(b) by 0 days.

(21) Appl. No.: 09/867,477

(22) Filed: May 31, 2001

(65) Prior Publication Data

US 2002/0181227 A1 Dec. 5, 2002

(51) Int. Cl.[7] ..... B25B 23/18

(52) U.S. Cl. ..... 362/119; 362/120; 362/109; 362/253; 362/802; 362/203

(58) Field of Search ..... 362/119, 120, 362/109, 253, 802, 203

(56) References Cited

U.S. PATENT DOCUMENTS 4,324,158 A * 4/1982 Le Roy ..... 362/119
5,826,968 A * 10/1998 Brantley et al. ..... 362/109
5,848,832 A * 12/1998 Hsieh ..... 362/119

* cited by examiner

*Primary Examiner*—Sandra O'Shea
*Assistant Examiner*—Bertrand Zeade
(74) *Attorney, Agent, or Firm*—Rosenberg, Klein & Lee

(57) ABSTRACT

A ratchet wrench and lighting circuit arrangement is constructed to include a ratchet member and a connector mounted in one end of a wrench body for grasping and turning nuts and bolts, a battery holder threaded onto the ratchet member to hold a battery set, and a lamp holder assembly installed in the connector and moved with the connector in the ratchet member between a first position where the circuit of the battery set and the lamp holder assembly is closed, causing the lamp bulb of the lamp holder assembly to emit light, and a second position where the circuit of the battery set and the lamp holder assembly is opened to turn off the lamp bulb of the lamp holder assembly.

4 Claims, 5 Drawing Sheets

RATCHET WRENCH AND LIGHTING CIRCUIT ARRANGEMENT

BACKGROUND OF THE INVENTION

The present invention relates to a ratchet wrench and, more particularly, to a ratchet wrench and lighting circuit arrangement, which can be conveniently set to turn on/off the lamp bulb of a lamp holder assembly installed therein.

A variety of hand tools including screwdrivers, wrenches, pliers, and etc., have been disclosed for different purposes. When using a hand tool to grasp or turn a workpiece in a dark place, an external light source is needed. Screwdrivers with lighting circuit means are well known. However, wrench with lighting circuit means are not commercially available.

SUMMARY OF THE INVENTION

The present invention has been accomplished under the circumstances in view. It is one object of the present invention to provide a ratchet wrench and lighting circuit arrangement, which comprises a lighting. circuit assembly that can be conveniently set between the on position and the off position. It is another object of the present invention to provide a ratchet wrench and lighting circuit arrangement, which comprises a lighting circuit assembly that can be removed from the wrench body without affecting the normal function of the ratchet wrench for grasping and turning nuts, bolts, etc. According to one aspect of the present invention, the ratchet wrench and lighting circuit arrangement comprises a ratchet member and a connector mounted in one end of a wrench body for grasping and turning nuts and bolts, a battery holder threaded onto the ratchet member to hold a battery set, and a lamp holder assembly installed in the connector and moved with the connector in the ratchet member between a first position where the circuit of the battery set and the lamp holder assembly is closed, causing the lamp bulb of the lamp holder assembly to emit light, and a second position where the circuit of the battery set and the lamp holder assembly is opened to turn off the lamp bulb of the lamp holder assembly. According to another aspect of the present invention, the lamp holder assembly and the battery set can be directly removed from the ratchet wrench after disconnection of the battery holder from the ratchet member, and the removal of the lamp holder assembly and the battery set does not affect the normal function of the ratchet wrench for grasping and turning nuts, bolts, etc.

BRIEF DESCRIPTION OF THE DRAWINGS

FIG. 3B is similar to FIG. 3A but showing the battery set disposed in contact with the metal spring of the lamp holder assembly, the lamp bulb turned on.

FIG. 5B is similar to FIG. 5A but showing the metal switching knob connected to the battery set, the lamp bulb turned on.

DETAILED DESCRIPTION OF THE PREFERRED EMBODIMENT

Figure 1:
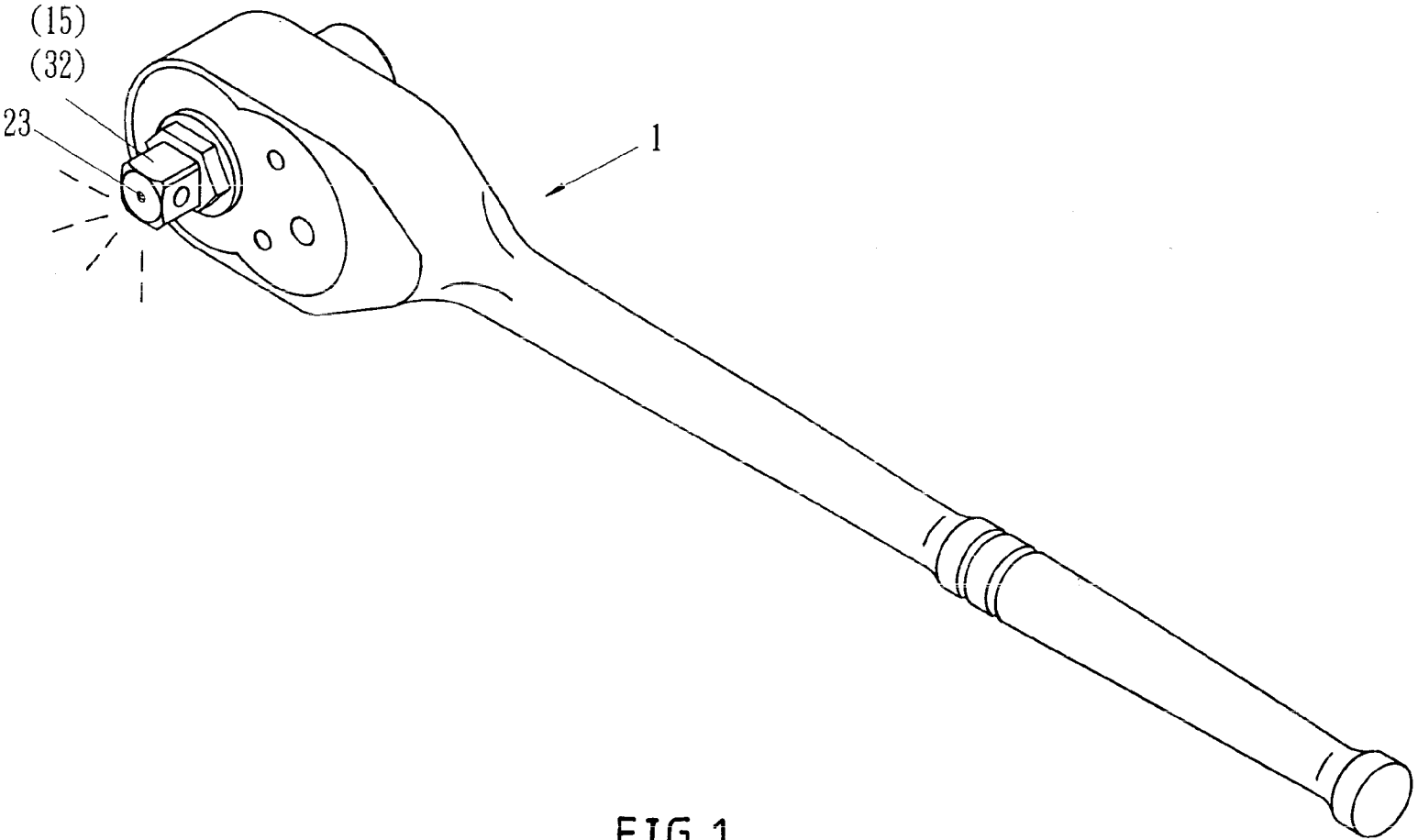
FIG. 1 is an elevational view of a ratchet wrench and lighting circuit arrangement according to a first embodiment of the present invention.

Referring to FIGS. from 1 through 3, the ratchet wrench and lighting circuit arrangement of the invention is generally comprised of a metal wrench body 1, a metal ratchet member 10 mounted in one end of the wrench body 1, a metal connector 15 coupled to the ratchet member 10 and projecting out of the wrench body 1, and a cover plate 5 covered on the wrench body 1 to hold the ratchet member 10 and the connector 15 in place. The connector 15 comprises a transversely extended peripheral hole 19 on the periphery of the lower half thereof outside the wrench body 1, a spring 190 mounted in the peripheral hole 19, and a steel ball 192 supported on the spring 190 and partially forced out of the peripheral hole 19 by the spring 190 to hold down the object to which the connector 15 is attached. The aforesaid structure is similar to a conventional ratchet wrench. The main features of the present invention are outlined hereinafter.

Figure 2:
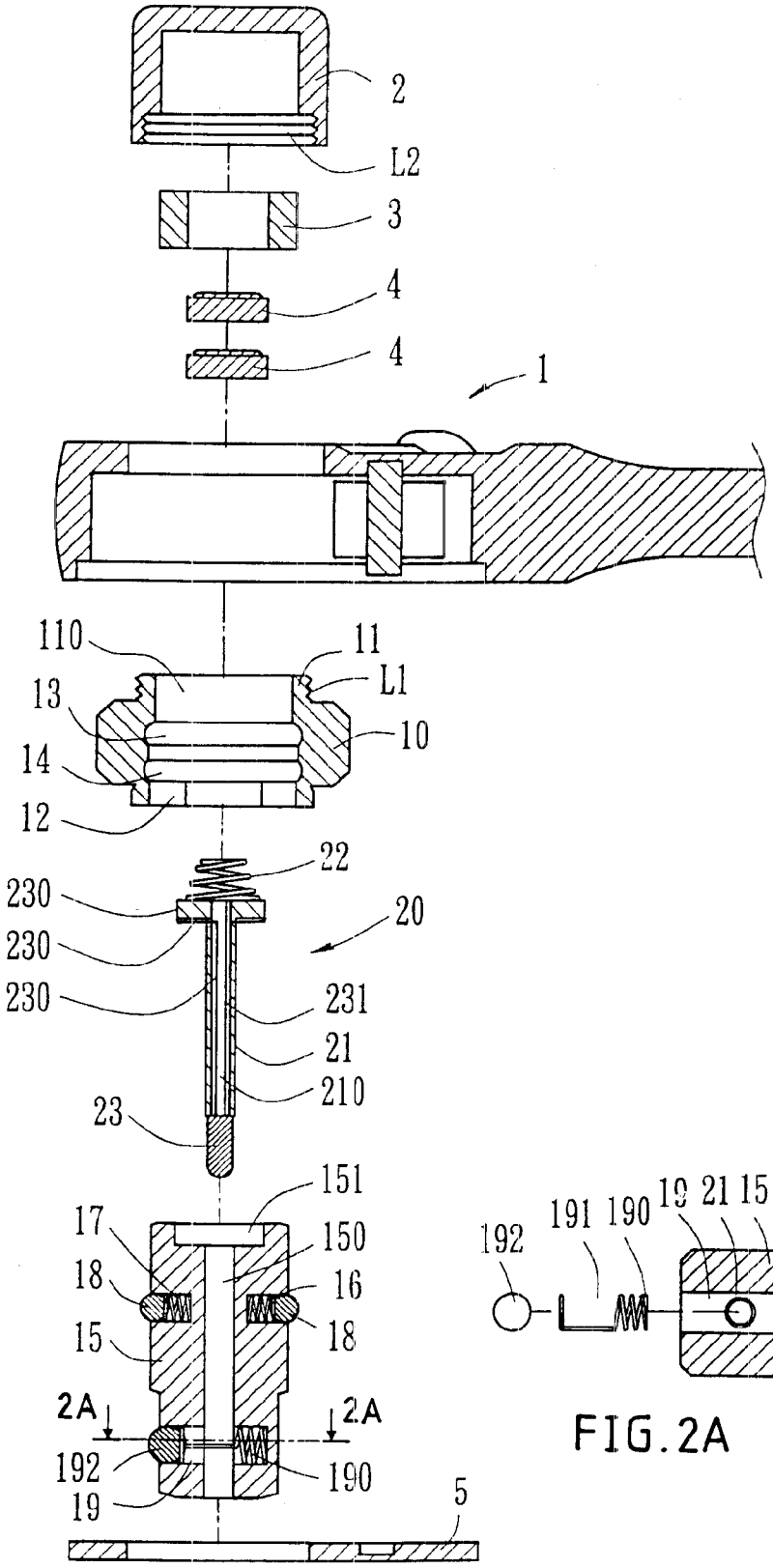
FIG. 2 is an exploded view in section of the first embodiment of the present invention.
Figure 2A:
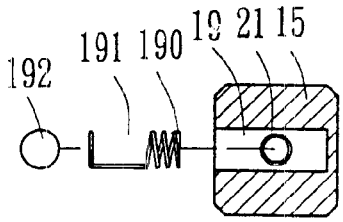
FIG. 2A is an exploded view in section of a part of the metal connector according to the first embodiment of the present invention.

Referring to FIGS. from 1 through 3 again, the ratchet member 10 is a hollow member having a polygonal bottom coupling hole 12 fitting the polygonal upper part of the connector 15, a top neck 11, a top circular hole 110 axially extended through the top neck 11 in alignment with the bottom coupling hole 12, an outer thread L1 extended around the periphery of the top neck 11, an upper inside annular groove 13 disposed between the top circular hole 110 and the bottom coupling hole 12, and a lower inside annular groove 14 disposed between the upper inside annular groove 13 and the bottom coupling hole 12. The connector 15 comprises an axial center through hole 150 extended through top and bottom end walls thereof, a top recess 151 on the top end wall in communication with one end of the axial center through hole 150, a plurality of peripheral holes 16 disposed around the periphery of the upper half thereof at same elevation, a spring 17 respectively mounted in each peripheral hole 16, and a steel ball 18 respectively supported on the spring 17 in each peripheral hole 16 and partially forced out of the periphery of the connector 15 by the respective spring 17. A lamp holder assembly 20 is mounted in the connector 15, and controlled to emit light. The lamp holder assembly 20 comprises a hollow cylindrical, electrically insulative holder shell 21, the holder shell 21 having an axially extended through hole 210, a metal spring 22 fixedly mounted on the top side of the holder shell 21, and a lamp bulb (LED)23 fixedly mounted on the bottom side of the holder shell 21. The lamp bulb 23 has a first lead-out wire 230 extended through the through hole 210 at one side and disposed in contact with the connector 15, and a second lead-out wire 231 extended through the through hole 210 at an opposite side and connected to the metal spring 22. A metal battery holder 2 is provided having an inner thread L2 threaded onto the outer thread L1 of the ratchet member 10. An electrically insulative bush 3 is mounted in the metal battery holder 2 to hold a battery set 4 inside the metal battery holder 2, keeping one terminal of the battery set 4 disposed in contact with the inside wall of the metal battery holder 2 and the other terminal of the battery set 4 aimed at the metal spring 22. Further, the spring 190 has a curved portion 191 (see FIG. 2A) closely attached to the peripheral wall of the axial center through hole 150 of the connector 15 such that the positioning of the lamp holder assembly 20 in the connector 15 does not hinder the compression and expanding effect of the spring 190.

As indicated above, the installation of the lamp holder assembly 20 and the battery holder 2 with the electrically insulative bush 3 and the battery set 4 does not hinder normal operation of the ratchet wrench to grasp and turn nuts, bolts, etc. After removable of the e lamp holder assembly 20 and the battery holder 2 with the electrically insulative bush 3 and the battery set 4 from the wrench body 1, the ratchet wrench still functions well as a normal wrench. Because the lamp holder assembly 20 is installed in the connector 15, the installation of the lamp holder assembly 20 does not increase the volume of the wrench body 1.

Figure 3A:
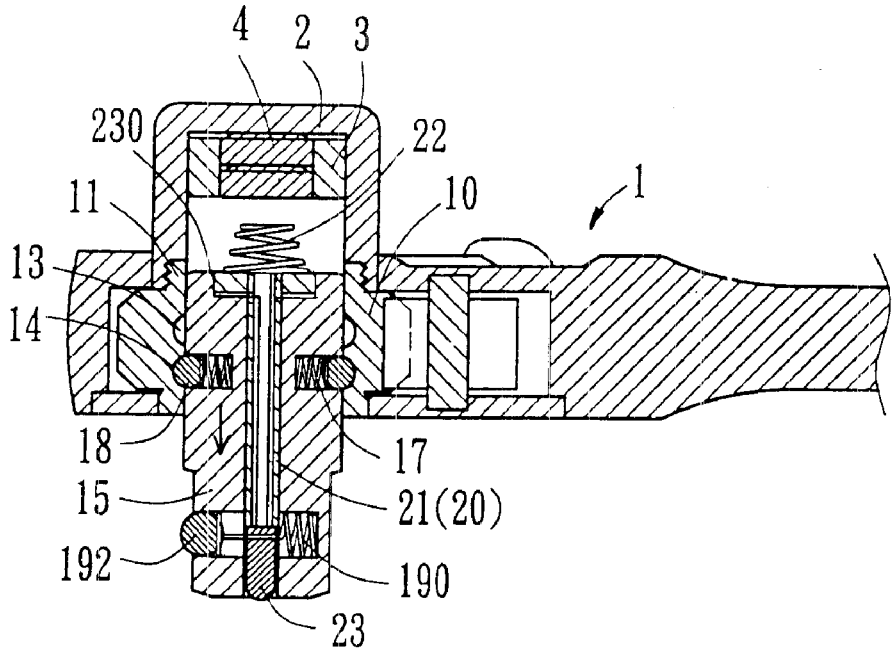
FIG. 3A is a sectional assembly view of the first embodiment of the present invention, showing the battery set disconnected from the lamp holder assembly.
Figure 3B:
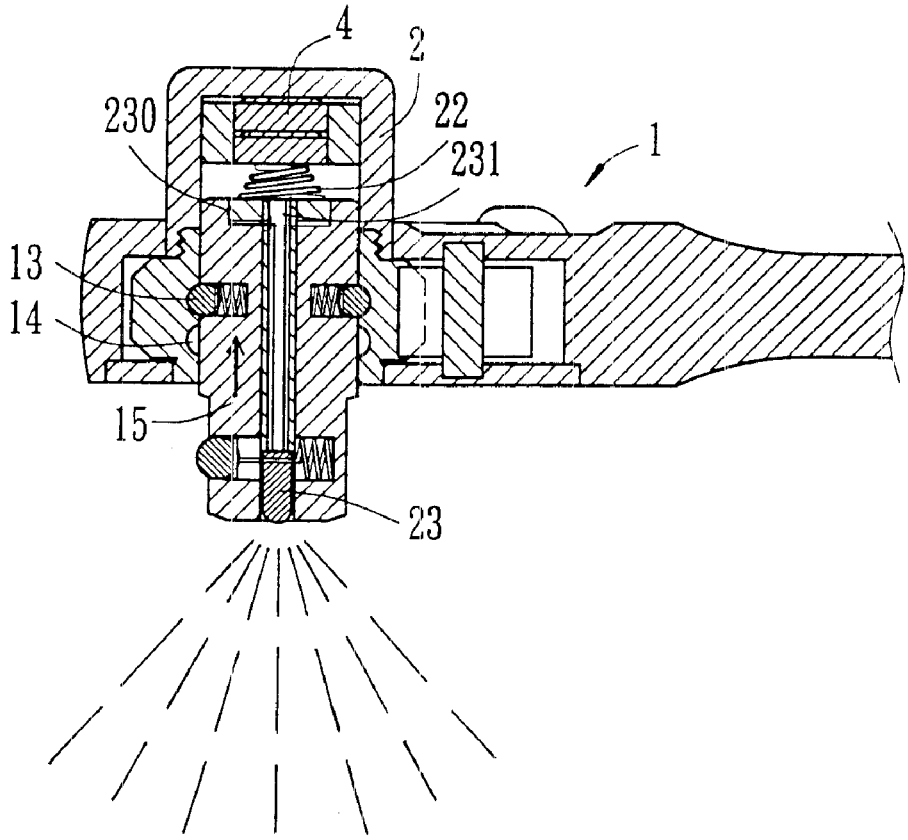

Referring to FIGS. 3A and 3B again, when assembled, the connector 15 can be moved in the ratchet member 10 between a first position shown in FIG. 3A where the steel balls 18 are forced into engagement with the lower inside annular groove 14 of the ratchet member 10 and the metal spring 22 is separated from the battery set 4 to open the circuit of the lamp bulb 23 and the battery set 4 and therefore the lamp bulb 23 is off, and a second position shown in FIG. 3B where the steel balls 18 are forced into engagement with the upper inside annular groove 13 of the ratchet member 10 and the metal spring 22 is disposed in contact with one terminal of the battery set 4 to close the circuit of the lamp bulb 23 and the battery set 4 and therefore the lamp bulb 23 is turned on to emit light.

Figure 4:
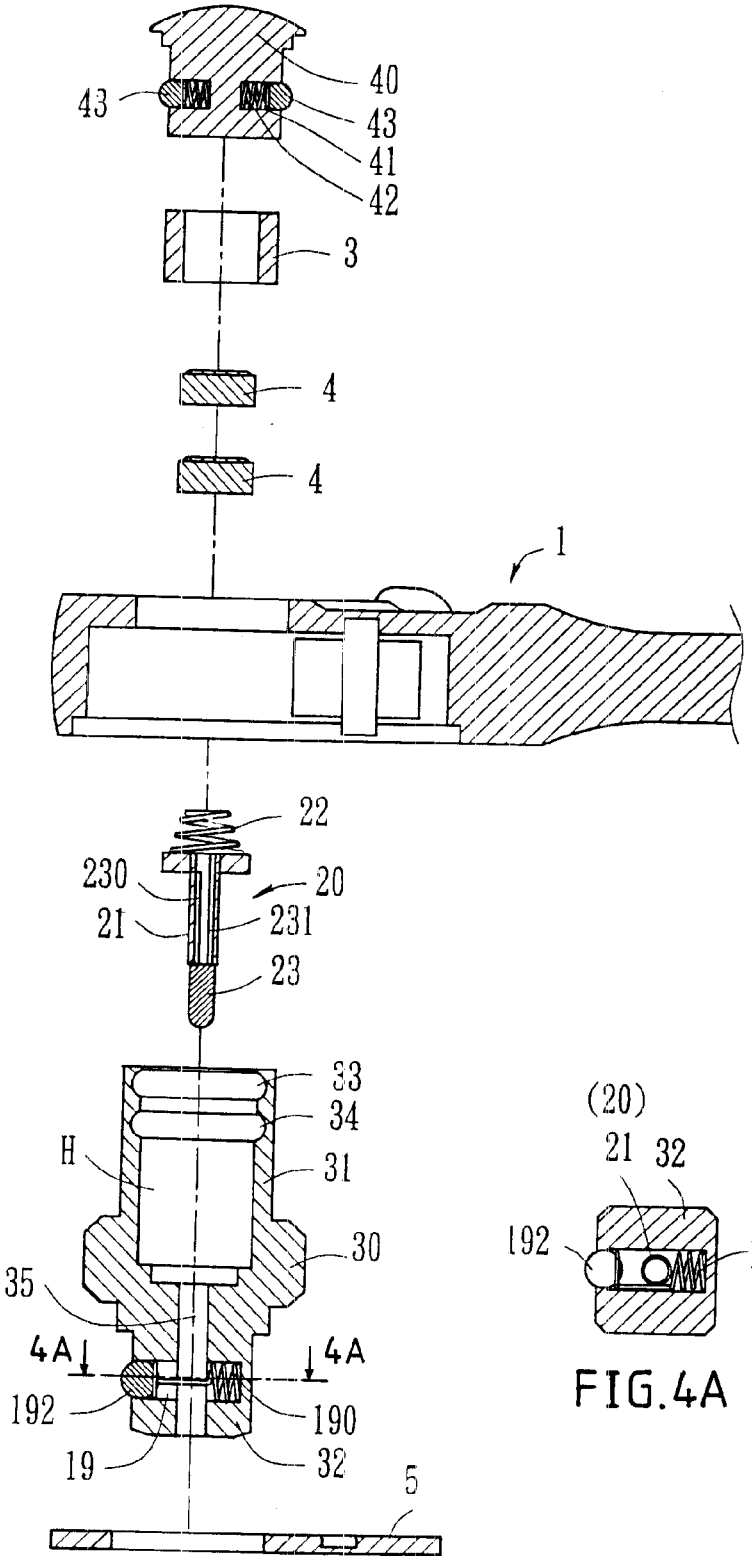
FIG. 4 is an exploded view of a second embodiment of the present invention.
Figure 4A:
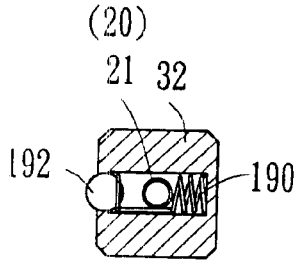
FIG. 4A is a sectional view taken along line 4A—4A of FIG. 4.
Figure 5A:
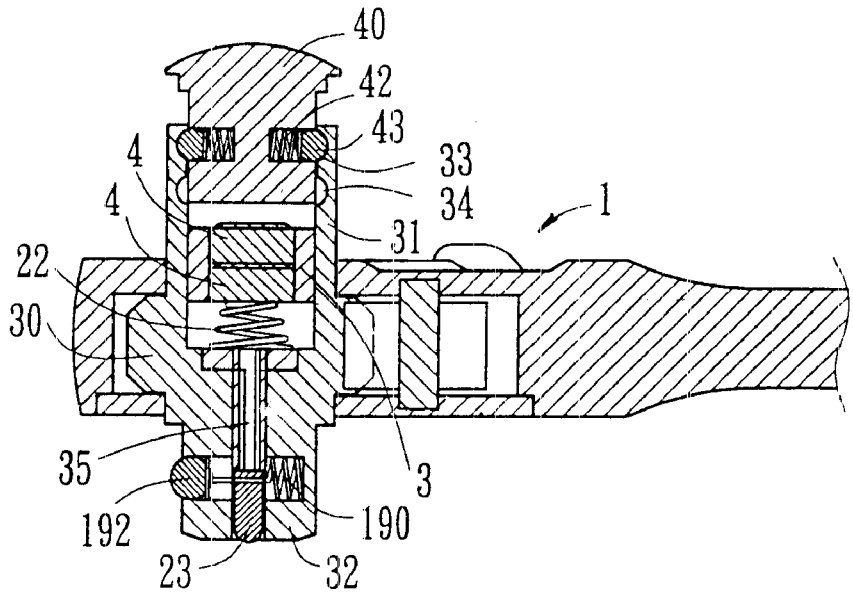
FIG. 5A is a sectional assembly view of the second embodiment of the present invention, showing the metal switching knob disconnected from the battery set, the lamp bulb turned off.
Figure 5B:
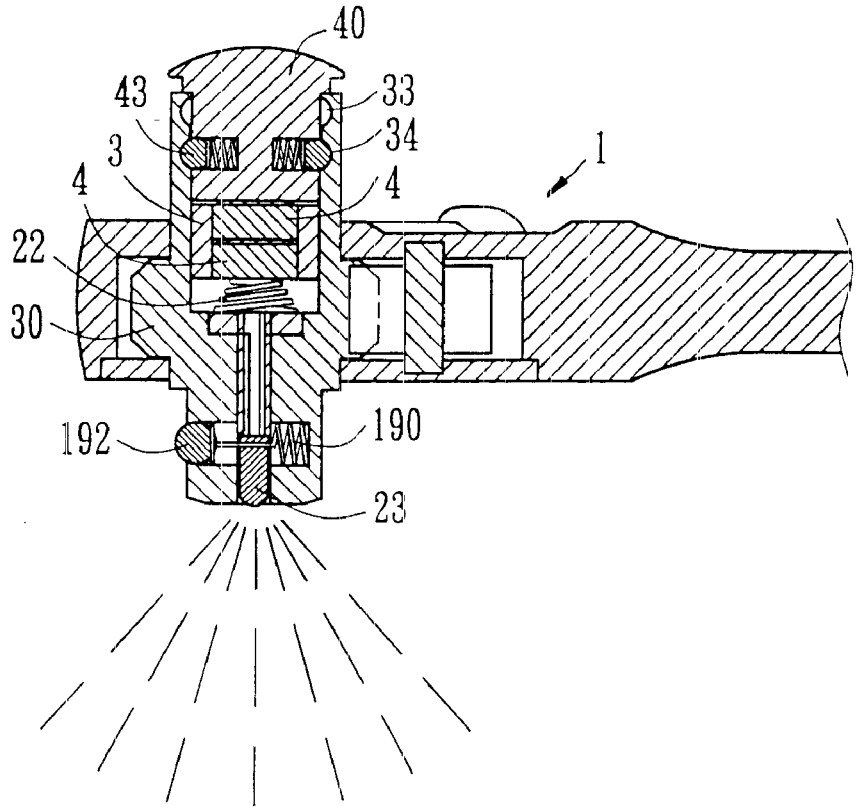

FIGS. 4 and 5 show an alternate form of the present invention. This embodiment is comprised of a wrench body 1, a ratchet member 30, a connector 32, a cover plate 5, a lamp holder assembly 20, a battery set 4, an electrically insulative bush 3, and a metal switching knob 40. The ratchet member 30 and the connector 32 are formed in integrity. The connector 32 comprises a longitudinal center through hole 35, a transversely extended peripheral hole 19 on the periphery thereof outside the wrench body 1, a spring 190 mounted in the peripheral hole 19, and a steel ball 192 supported on the spring 190 and partially forced out of the peripheral hole 19 by the spring 190 to hold down the object to which the connector 32 is attached. The structure of the lamp holder assembly 20 is same as the embodiment shown in FIG. 2. The ratchet member 30 comprises an upward extension tube 31 defining an axially extended chamber H, an upper inside annular groove 33 and a lower inside annular groove 34 disposed inside the upward extension tube 31 around the chamber H. The lamp holder assembly 20 is installed in the longitudinal center through hole 35 of the connector 32. The electrically insulative bush 3 is fitted into the chamber H of the ratchet member 30 to hold the battery set 4 on the inside, keeping one terminal of the battery set 4 in contact with the metal spring 22 of the lamp holder assembly 20. The metal switching knob 40 is partially inserted into the chamber H of the ratchet member 30, comprising a plurality of transversely extended peripheral holes 41, a plurality of springs 42 respectively mounted in the peripheral holes 41, and a plurality of steel balls 43 respectively supported on the springs 42 and partially forced out of the periphery of the metal switching knob 40. The metal switching knob 40 is moved axially in the ratchet member 30 between a first position where the steel balls 43 engage the upper inside annular groove 33 to hold the metal switching knob 40 away from the battery set 4 and the lamp bulb 23 of the lamp holder assembly 20 is switched off (see FIG. 5A), and a second position where the steel balls 43 engage the lower inside annular groove 34 to hold the metal switching knob 40 in contact with one terminal of the battery set 4 and the lamp bulb 23 of the lamp holder assembly 20 is electrically connected to emit light (see FIG. 5B).

A prototype of ratchet wrench and lighting circuit arrangement has been constructed with the features of FIGS. 1~5. The ratchet wrench and lighting circuit arrangement functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A ratchet wrench and lighting circuit arrangement, comprising:

a wrench body having first and second opposing ends;

a hollow ratchet member formed of metal being mounted in said first end of said wrench body and having a pair of annular grooves formed in an axial passage thereof, said pair of annular grooves defining an upper inside annular groove and a lower inside annular groove, said hollow ratchet member including an externally threaded top neck with a circular hole formed at one end of said axial passage at a corresponding end of said hollow ratchet member, said hollow ratchet member having a polygonally shaped coupling hole at an opposing end of said axial passage, said circular hole being aligned with said coupling hole, said upper inside annular groove being disposed between said circular hole and said coupling hole, said lower inside annular groove being disposed between said upper inside annular groove and said bottom hole;

a connector having an axial central through hole formed therein and upper and lower portions, said upper portion being coupled to said hollow ratchet member and having a plurality of transversely extended peripheral holes formed therein, each of said peripheral holes receiving a spring and a steel ball mounted on said spring and partially projecting therefrom, each said steel ball of said upper portion retaining said connector to said hollow ratchet member and said connector being selectively axially displaced between a first position where said steel balls are received within said upper inside annular groove and a second position where said steel balls are received in said lower inside annular groove, said lower portion having a transversely extended peripheral hole formed therein, said peripheral hole of said lower portion receiving a spring and a steel ball mounted on said spring of said lower portion and partially projecting therefrom;

a cover plate having an opening formed therethrough and being coupled to said first end of said wrench body, said cover plate securing said hollow ratchet member and said connector to said wrench body;

a battery holder formed of metal being threaded onto said externally threaded top neck of said hollow ratchet member, said battery holder including an electrically insulative bush and a set of batteries mounted therein, said battery set having a first terminal disposed in contact with said battery holder and a second terminal spaced from and directed toward said hollow ratchet member; and a lamp holder assembly mounted in said axial central through hole of said connector, said lamp holder assembly being axially displaceable with said connector between said first and second positions, whereby displacement said connector to said first position connects said lamp holder to said battery set and to emit light, and displacement of said connector to said second position disconnects said lamp holder assembly from said battery set and extinguishes the light.

2. The ratchet wrench and lighting circuit arrangement of claim 1, wherein said spring in said peripheral hole of said lower portion of said connector includes a curved portion extending along a periphery of said axial central through hole of said connector for enabling a holder shell of said lamp holder assembly to be inserted into or removed from said axial central through hole of said connector.

3. The ratchet wrench and lighting circuit arrangement of claim 1, wherein said lamp holder assembly comprises a hollow cylindrical electrically insulative holder shell mounted in said axial central through hole of said connector, a spring being fixedly mounted on a top side of said holder shell and moved with said holder shell and said connector relative to said battery set, and a lamp bulb mounted on a bottom side of said holder shell, said lamp bulb having a first lead-out wire disposed in contact with said connector and a second lead-out wire connected to said spring of said lamp holder assembly.

4. A ratchet wrench and lighting circuit arrangement, comprising:

a wrench body having first and second opposing ends;

a ratchet member formed of metal being mounted in said first end of said wrench body and having an axially extended chamber open on a top end of said ratchet member, said axially extended chamber having a pair of annular grooves formed therein and defining an upper inside annular groove and a lower inside annular groove, said ratchet member having an electrically insulative bush mounted within said axially extended chamber, said ratchet member having a connector projecting from a lower portion of said ratchet member, said connector having a transversely extended peripheral hole formed therein, said peripheral hole receiving a spring and a steel ball mounted on said spring;

a cover plate having an opening formed therethrough and being coupled to said first end of said wrench body, said cover plate fixedly securing said ratchet member to said wrench body;

a lamp holder assembly mounted in said connector, said lamp holder assembly including (a) an electrically insulative holder shell mounted in said connector, (b) a spring mounted on a top portion of said holder shell and extending into said axially extended chamber of said ratchet member, and (c) a lamp bulb mounted to a bottom end of said holder shell, said lamp bulb having a first lead-out wire disposed in contact with said ratchet member and a second lead-out wire connected to said spring of said lamp holder assembly;

a battery set being disposed within said electrically insulative bush, said battery set having first and second terminals, said first terminal engaging said spring of said lamp holder assembly; and, a switching knob partially inserted into said axially extended chamber, said switching knob having a plurality of peripheral holes formed therein, each of said peripheral holes receiving a spring and a steel ball mounted on said spring and partially extending from said peripheral hole of said switching knob, whereby said switching knob is selectively displaceable form a position where said steel balls of said switching knob are received in said upper inside annular groove and said switching knob is spaced from said battery set, to a position where said steel balls of said switching knob are received in said lower inside annular groove and said switching knob is in contact with said battery set to thereby energize said lamp bulb.

* * * * *